United States Patent [19]

Creatura

[11] 4,425,383

[45] Jan. 10, 1984

[54] PROCESS FOR OXIDATION OF CARRIER PARTICLES

[75] Inventor: John A. Creatura, Webster, N.Y.

[73] Assignee: Xerox Corporation, Stamford, Conn.

[21] Appl. No.: 395,161

[22] Filed: Jul. 6, 1982

[51] Int. Cl.[3] ..... B05D 7/00

[52] U.S. Cl. ..... 427/216; 148/6.35; 427/213; 427/221; 427/327

[58] Field of Search ..... 427/213, 216, 221, 327; 148/6.35, 6

[56] References Cited

U.S. PATENT DOCUMENTS

| | | | |
|---|---|---|---|
| 2,728,696 | 12/1955 | Singer | 148/6.35 |
| 3,377,213 | 4/1968 | Hiller | 148/6.35 |
| 3,617,394 | 11/1971 | Mayer | 148/6.35 |
| 3,767,477 | 10/1973 | McCabe et al. | 148/6.35 |
| 3,906,125 | 9/1975 | Uher | 148/6.35 |
| 3,923,503 | 12/1975 | Hagenbach | 96/1 SD |
| 4,035,200 | 7/1977 | Valentijn | 148/6.35 |
| 4,158,561 | 6/1979 | Pavlik et al. | 75/0.5 BA |
| 4,223,085 | 9/1980 | Hagenbach et al. | 430/108 |
| 4,294,628 | 10/1981 | Kasuya | 148/6.35 |
| 4,297,150 | 10/1981 | Foster et al. | 148/6.35 |

*Primary Examiner*—Norman Morgenstern
*Assistant Examiner*—Janyce A. Bell
*Attorney, Agent, or Firm*—E. O. Palazzo

[57] ABSTRACT

This invention is directed to an improved process for treating steel carrier core surfaces which comprises providing a steel carrier core composition, oxidizing in the air stream the surface of the carrier core at a temperature of from about 500 degrees Fahrenheit to about 1,000 degrees Fahrenheit, adding water to the air stream prior to accomplishing the oxidation reaction, at a partial pressure of water in excess of 20 millimeters of mercury, thereby resulting in carrier cores having a resistance of from about $10^5$ ohm-cm to about $10^{12}$ ohm-cm.

8 Claims, No Drawings

PROCESS FOR OXIDATION OF CARRIER PARTICLES

BACKGROUND OF THE INVENTION

This invention is generally directed to an improved process for preparing carrier particles, and more specifically, the present invention is directed to an improved process for oxidizing steel carrier cores, which oxidation results in carrier particles having improved triboelectric properties. In one very important aspect of the present invention, the process for producing the improved carrier particles is accomplished by effecting the oxidation reaction in the presence of water.

Numerous different methods are known for the prepartion of carrier particles useful as a component in developer compositions for electrostatographic imaging systems. Many of these processes involve treating commercially available steel particles, or beads, in an air or oxygen atmosphere at a temperature ranging from about 500 degrees Fahrenheit to about 1,000 degrees Fahrenheit. For example, these is disclosed in U.S. Pat. No. 3,923,503, the production of highly shaped, classified, low carbon steel beads, which have been heat treated to a tempered microstructure with an average hardness of 40–45 Rockwell C. In one variation of the process described in the '503 patent, carrier core materials are prepared by heat treatment in an air or oxygen atmosphere at temperatures ranging from about 500 degrees Fahrenheit to about 1000 degrees Fahrenheit, thereby providing oxidized carrier cores having a surface oxide layer comprising $Fe_3O_4$ in a thickness of between 0.2 and 5.0 microns. According to the disclosure of this patent, the resulting oxidized low carbon steel carrier beads when subsequently coated with polymer materials, provide coated electrostatographic carrier beads having an increased coating to core adhesion, thereby resulting in longer machine life, and permitting faster machine speeds when utilizing such carrier particles.

In U.S. Pat. No. 3,767,477 there is described the preparation of oxide coated iron powders with a uniform oxide film, and having a resistance which can be selectively controlled, involving a detailed five-step process including fluidizing the iron particles in air while heating, introducing an inert gas such as nitrogen into the air, discontinuing the flow of the air but maintaining fluidization, introducing air into the inert gas and cooling the fluidized iron powder, and discontinuing the inert gas flow but maintaining fluidization in air while cooling the iron powder to a lower temperature. Carrier particles prepared in accordance with such a process apparently improve image development characteristics, and avoid fringe development.

Other processes are known for generally treating ferrous surfaces, other than iron core carrier particles. Thus, there is described in U.S. Pat. No. 2,728,696 the preparation of a strongly adherent coating consisting of hydrated ferrite oxide produced by forming on the surface involved, a film of a dilute aqueous solution of acid, or an acid reacting salt, followed by subjecting the surface to air in the presence of water vapor. Additionally, processes for treating and/or causing oxidation of various metal surfaces are described in U.S. Pat. Nos. 3,617,394, and 3,377,213.

While many methods and compositions are known for controlling the electrical properties of carrier particles, there continues to be a need for a simple and an economical process for oxidizing carrier particles wherein, for example, the electrical properties of the resulting carrier particles can be more suitably controlled over extended periods of time. Additionally, there continues to be a need for an improved process for preparing oxidized carrier particles wherein the surface texture of the resulting particles are controlled, which need is satisfied with the process of the present invention.

SUMMARY OF THE INVENTION

It is a feature of the present invention to provide an improved process for preparing carrier core particles.

Another feature of the present invention resides in the provision of an improved process for treating carrier core materials in the presence of water.

In yet another feature of the present invention, there is provided an improved process for oxidizing carrier core surfaces in the presence of water, resulting in carrier particles having controlled electrical properties.

In yet another feature of the present invention, there is provided an improved process for treating carrier core surfaces wherein there results carrier particles containing a minimum ratio of ferric oxide to other substances, such as magnitites on the surface.

These and other features of the present invention are accomplished by the provision of an improved process for treating steel carrier core surfaces comprising (1) providing a steel carrier core composition, (2) oxidizing in an air stream, the surface of the carrier core at a temperature of from about 500 degrees Fahrenheit to about 1,000 degrees Fahrenheit, (3) adding water to the air stream prior to accomplishing the oxidation reaction, thereby resulting in carrier cores having a resistance of from about $10^5$ ohm-cm to about $10^{12}$ ohm-cm, and capable of being triboelectrically charged to about −5 microcoulombs per gram to about −40 microcoulombs per gram. The resulting carrier cores contain a minimum of from about 0.1 weight percent to about 10 weight percent, and preferably from about 0.3 weight percent to about 3.0 weight percent of iron oxides, as $Fe_2O_3-Fe_3O_4$. Accordingly, the process of the present invention is accomplished in the presence of an aqueous medium, the partial pressure of which can be adjusted so as to obtain the results desired. The partial pressure at which the process of the present invention is accomplished is generally in excess of 20 millimeters of mercury partial pressure of water in an airstream. Thus in the process of the present invention, the partial pressure selected ranges from about 20 millimeters of mercury partial pressure of water in an air stream to about 1 atmosphere of mercury water pressure as an upper limit, and preferably from about 30 millimeters of mercury partial pressure of water in an air stream to about 200 millimeters of mercury partial pressure of water in an air stream.

More specifically, the process of the present invention involves the following steps.

(1) Providing a steel carrier core composition such as Hoeganaes 80/150, commercially available from Hoeganaes Corporation, Riverton, N.J.;

(2) Oxidizing at a temperature of about 650 degrees Fahrenheit (°F.) although temperatues within the range of from 500 ° F. to 1,000° F. can be selected the surface of the carrier core in air, such as a continuous stream of air at one atmosphere of pressure, wherein the air has been conditioned and controlled to a predetermined water content. By pre-determined water content is meant that there is present in the air from about 30 millimeters partial pressure of water to about 300 millimeters partial pressure of water. Thus in this specific illustration, the reactants are a steel iron powder, oxygen and water. It is believed, although it is not desired to be limited by theory, that the presence of oxygen favors the formation and generation of $Fe_2O_3$, while the presence of water favors the generation and formation of $Fe_3O_4$. Futher it is believed that the $Fe_2O_3$ provides the electrical resistance requirements for the core carrier material, and that the $Fe_3O_4$ provides a lower surface area core and better adhesion to the core of the oxide layer composite.

The oxidation treatment time depends on a number of factors, such as the temperature used, however generally this time ranges from a few minutes to about 3 hours, and preferably from about 30 minutes to about 60 minutes.

The process of the present invention is typically accomplished in a rotary kiln apparatus commercially available from Harper Corporation however, other similar known types of apparatus can be employed including, for example fluid bed devices, static oven systems, continuous belt apparatus, and the like.

Illustrative examples of steel carrier cores that can be treated with the process of the present invention include those materials commercially available from Hoeganaes Inc, Quebec Metals Inc., and others, including Hoeganaes 80/150, Quebec Metals QMP 69, Nuclear Metals 100, and the like.

The resulting treated carrier cores can then be coated as known in the art, reference U.S. Pat. No. 3,526,533, coating weight from about 0.1 to about 5 percent by weight, with suitable coating materials, illustrative examples of which include various resins, such as thermoplastic resins or partially cured thermosetting resins. Examples of thermoplastic resins that can be selected include polyolefins, such as polyethylene, polypropylene, chlorinated polyethylenes, chlorosulfunated polyethylenes, polyvinyls, polyvinylidenes, such as polystyrene, polymethylstyrene, polyvinylacetate, polyvinylchloride, polyvinylethers, fluorocarbons such as polytetrafluoroethylene, polyvinylfluoride, polyesters, polyurethanes, epoxies, and the like. Preferred coating resins include styrene methacrylate organosilicon terpolymer carrier coating compositions, such as those described in U.S. Pat. No. 3,526,533.

The carrier particles prepared in accordance with the process of the present invention may then be utilized together with various toner particles comprised of resin particles, and pigment particles, such as carbon black, for the purpose of developing images in electrostatographic imaging systems. Illustrative examples of toner resins include those mentioned herein with regard to the coatings that can be selected for the carrier material. Preferred toner resins include polyesters, polymers of polystyrene, copolymers of styrene and methacrylate, particularly styrene and n-butylmethacrylate, and the like. Generally, from about 1 part by weight of toner particles is mixed with about 100 parts by weight of carrier particles.

The diameter of the carrier particle used in the developer compositions should possess sufficient density and inertia to avoid adherance to the electrostatic latent image during development. Accordingly, the carrier particles should have a diameter of from about 50 microns to about 1,000 microns.

The developer compositions of the present invention, can be employed in electrostatographic imaging systems wherein an electostatic latent image is formed on an imaging member, followed by contacting the imaging member with a developer composition comprising the carrier particles prepared in accordance with the process of the present invention; subsequently transferring the developed image to a suitable substrate, and optionally permanently affixing the image thereto. Examples of useful imaging members include those known in the art, such as selenium, alloys of selenium with arsenic and tellurium, halogen doped selenium, halogen doped selenium alloys; organic photoresponsive devices, such as those comprised of photogenerating and charge carrier transport layers, as described in U.S. Pat. No. 4,265,990, the disclosure of which is totally incorporated herein by reference, and the like.

The following examples are being supplied to further define the specifics of the present invention, it being noted that these examples are intended to illustrate and not limit the scope of the invention. Parts and percentages are by weight unless otherwise indicated.

EXAMPLE I

There was prepared carrier particles by subjecting in a rotary tube furnace, steel carrier core particles commercially available from Hoeganaes, (80/150) to an oxidation reaction at a temperature of 648 degrees Fahrenheit (°F.) and a pressure of one air atmosphere, the air being delivered in stream at a rate of 20 CFH (cubic feet per hour). Prior to delivery the air was humidified to 30 millimeters mecury partial pressure. The reaction was allowed to continue for a period of 52 minutes. After cooling to room temperature, there was separated from the reaction mixture the treated carrier core particles. Chemical analysis revealed that the carrier core contained 0.27 percent oxygen as compared to 0.07 percent prior to treatment. Additionally, the resulting carrier core particles has a measured resistivity of $1.2 \cdot 10^8$ ohm-cm.

The resulting carrier particles were then coated with 0.175 percent by weight of a polyvinylidene fluoride resin commercially available from Pennwalt Corporation.

A developer composition was prepared by mixing 97 parts by weight of the above-prepared carrier particles with 3 parts by weight of a toner composition, containing a styrene/n-butylmethacrylate copolymer resin, consisting of 65 percent by weight of styrene and 35 percent by weight of n-butylmethacrylate, the resin being present in an amount of 90 weight percent; 8 percent by weight of Regal 330 carbon black, and 2 percent by weight of the charge enhancing additive cetyl pyridinium chloride. This developer composition which had a triboelectric value of −30 microcoulombs per gram as determined by the known Faraday Cage technique, was then empolyed to develop electrostatic latent images contained on a layered photoresponsive device comprised of an aluminum substrate overcoated with a generating layer of trigonal selenium, which in turn is overcoated with a transport layer of N,N'-diphenyl-N,N'-Bis(3-methylphenyl) [1,1'-biphenyl-4,4']diamine dispersed in a polycarbonate resin, which device was prepared as described in U.S. Pat. No. 4,265,990, the disclosure of which is totally incorporated herein by reference, and there resulted excellent copies of superior resolution after repeated imaging cycles.

Developer aging tests were then accomplished with the above photoresponsive device wherein imaging was effected however, the image was not transferred to a paper substrate. The developer composition remained stable for over 100,000 developed copies. In comparison, an identical developer composition, with the exception that it contained carrier particles prepared by oxidization without water, evidenced continued stability decrease with age. By stability is meant that the measured triboelectric produce value (toner concentration multiplied by the triboelectric charge in microcoulombs per grams of developer composition) of the developer composition remained essentially constant, thus, the carrier particles produced in accordance with the process of the present invention results in an oxide coating that has superior wearability properties in view of its superior adhesion to the core surface and further, the resin coating in turn has better adhesion to the oxide coating.

EXAMPLE II

The procedure of Example I was repeated several times over a broad range of water partial pressures resulting in carrier core particles having the following properties wherein;

(1) voltage breakdown ($V_{BD}$) a design criterion, represents the electrical breakdown voltage value measured on carrier core materials contained in a laboratory cell device assembled for this purpose, wherein the breakdown voltage in a defined field geometry is determined. The value reported represents the point at which the resistance of the oxide coating decreases abruptly causing the resulting material to become conductive, (2) adhesion optical density (O.D.) the optical density, which is a logrithmic function, was obtained utilizing a test procedure in which the oxided core was mechanically agitated, followed by removal and transfer of the loosened oxides and colored microscopic debris to a test sheet of white paper. The optical density of the stain remaining on the white paper subsequent to transfer of the oxides and microscopic debris is then measured using a GAM Digital Densitometer, Model 126P. Poor oxide adherence is reflected in a high optical density value;

(3) BET (Brunauer, Emmett, and Teller) represents the surface area of the oxide powder in $cm^2$/gram, based on adsorption relationships in accordance with the procedure developed by Brunauer, Emmett and Teller. Lower surface number values indicate reduced texture on the carrier core surface, thus resulting in a oxide film that more strongly adheres to the core surface;

(4) resistivity—represents the measured value of the oxided core as determined on a laboratory cell device assembled for this purpose at a 10 volt potential across a nominal 0.1 inch gap;

(5) percent oxygen is determined by the weight loss of the carrier particle after being subjected to a hydrogen reduction in a tube furnace at 850° C.

| | Atmosphere Partial Pressure (pp) $H_2O$ (mmHg) | $V_{BD}$ (Volts) | Resistivity (ohm cm)$^{-1}$ | Adhesion (O.D.) | % Oxygen | BET ($cm^2$/gm) |
|---|---|---|---|---|---|---|
| 1-A | 10 mm | 110 | $4.5 \times 10^8$ | .14 | .66 | 1168 |

-continued

| | Atmosphere Partial Pressure (pp) $H_2O$ (mmHg) | $V_{BD}$ (Volts) | Resistivity (ohm cm)$^{-1}$ | Adhesion (O.D.) | % Oxygen | BET ($cm^2$/gm) |
|---|---|---|---|---|---|---|
| | (ambient air) | | | | | |
| 1-B | 170 mm | 101 | $8.8 \times 10^8$ | .02 | .74 | 778 |
| 2-A | 10 mm (ambient air) | 134 | $1.8 \times 10^9$ | .13 | .71 | 1144 |
| 2-B | 170 mm | 127 | $2.1 \times 10^9$ | .07 | .83 | 803 |

Carrier cores processed in ambient air had a higher BET value, namely, 1168 and 1144 which indicates that more coating material would be required, which is not desired. In such situations, more coating material is necessary because a higher proportion of the applied polymer locates at the sub surface sites ofthe carrier core, and is thus not available for contact charging of the toner particles. Aslo the adhesion (O.D.) values are lower for carrier particles prepared in accordance with processes 1-B and 2-B, thus the adhesion of the oxide layers to sub particles is improved despite an increase in the percentage of oxide present

EXAMPLE III

The carrier core particles prepared in accordance with Example I were analyzed for oxide species after introducing water into the oxidizing atmosphere for the purpose of achieving a more magnetite rich composition, that is, to the raw material was added ($Fe_2O_3$-$Fe_3O_4$), and the resulting composition was subjected to analytical analysis with the following results

| I. | $V_{BD}$ (Volts) | Relative % Oxides $Fe_3O_4$ | $Fe_2O_3$ | FeO |
|---|---|---|---|---|
| Raw Core Starting Material | nil | 18 | 0 | 82 |
| 10 mm Hg Partial Pressure $H_2O$ | 144 | 56.2 | 14.1 | 29.7 |
| 170 mm Hg Partial Pressure $H_2O$ | 140 | 82 | 10 | 8 |

Carriers prepared from air and water rich oxidized cores

| II. Core Oxidized by: | Core Properties (coated with 0.18 percent of Kynar ®) BET $cm^2$/gm | Adhesion. O.D. | Carrier Properties Carrier Tribo (uc/gm) |
|---|---|---|---|
| Ambient Air (10 mm Hg partial pressure $H_2O$) | 751 | .04 | −27 |
| Water Rich Mixture - 170 mm Hg partial pressure $H_2O$ | 637 | .00 | −31 |

With regard to the results illustrated in Table II above, the following is noted:

a. The BET $cm^2$/gm values are significantly lower, 114 $cm^2$/gm for the water rich mixture (170 mm) indicating lower surface areas for such cores.

b. Core adhesion, is significantly lower for the water rich carrier cores (170 mm) indicating better wearing surfaces for such cores.

c. The carrier tribo is higher for the water rich mixture (170 mm) carrier material, in view of the lower BET. Thus, more polymer coating is available for tribo contact with the toner particles.

Other modifications of the present invention will occur to those skilled in the art upon reading of the present disclosure. These are intended to be included within the scope of this invention.

I claim:

1. An improved process for treating steel carrier core surfaces which consisting essentially of providing steel carrier core particles, oxidizing in an air stream the surface of the carrier core particles at a temperature of from about 500 degrees Fahrenheit to about 1,000 degrees Fahrenheit, adding water to the air stream prior to accomplishing the oxidation reaction, at a partial pressure of water in excess of 20 millimeters of mercury, thereby resulting in carrier cores having a resistance of from about $10^5$ ohm-cm to about $10^{12}$ ohm-cm.

2. An improved process in accordance with claim 1 wherein the partial pressure of water ranges from about 30 millimeters of mercury to about 300 millimeters of mercury.

3. A process in accordance with claim 1 wherein the oxidizing reaction is accomplished for a period of about 1 hour and the temperature of oxidation is about 650 degrees Fahrenheit.

4. The process in accordance with claim 1 wherein the resulting carrier core particles contain from about 0.1 weight percent to about 10 weight percent of iron oxides.

5. A process in accordance with claim 4 wherein the iron oxides are comprised of $Fe_2O_3$. $Fe_3O_4$.

6. A process in accordance with claim 1 wherein the resulting carrier core is coated with a fluoropolymer.

7. A process in accordance with claim 6 wherein the fluoropolymer is polyvinylidene fluoride.

8. A process in accordance with claim 1 wherein the resulting carrier particles are capable of triboelectrically charging to from about minus 5 microcoloumbs per gram to about minus 40 microcoloumbs per gram.

* * * * *

UNITED STATES PATENT AND TRADEMARK OFFICE

CERTIFICATE OF CORRECTION

PATENT NO. : 4,425,383

DATED : January 10, 1984

INVENTOR(S) : John CREATURA, ET AL.

It is certified that error appears in the above-identified patent and that said Letters Patent is hereby corrected as shown below:

On the front page of the patent, under Item [75] INVENTORS, please add -- Charles G. Dickerson, Rochester, New York; and Stephen A. Strella, Rochester, New York. --

Signed and Sealed this

*Fourteenth* Day of *August 1984*

[SEAL]

*Attest:*

GERALD J. MOSSINGHOFF

*Attesting Officer*

*Commissioner of Patents and Trademarks*